US005791927A

United States Patent [19]

Iannone

[11] Patent Number: 5,791,927

[45] Date of Patent: Aug. 11, 1998

[54] MEANS FOR SEALING A LIGHT BULB IN A SOCKET

[76] Inventor: Sam Iannone, 15 W. Willow St., Beacon, N.Y. 12508

[21] Appl. No.: 762,843

[22] Filed: Dec. 10, 1996

[51] Int. Cl.[6] ..... H01R 13/52

[52] U.S. Cl. ..... 439/280; 439/271; 439/615

[58] Field of Search ..... 439/280, 602, 439/587, 615, 271

[56] References Cited

U.S. PATENT DOCUMENTS

| | | | |
|---|---|---|---|
| Re. 32,787 | 11/1988 | Gallusser et al. | 439/271 |
| 382,110 | 5/1888 | Reilly . | |
| 503,349 | 8/1893 | Lee . | |
| 1,224,030 | 4/1917 | Smith . | |
| 1,321,934 | 11/1919 | Merchant . | |
| 1,825,867 | 10/1931 | Hopland . | |
| 1,911,612 | 5/1933 | Eckstein et al. . | |
| 1,933,511 | 10/1933 | Manson | 439/587 |
| 2,119,452 | 5/1938 | Woodhead . | |
| 2,151,882 | 3/1939 | Woodhead . | |
| 3,040,285 | 6/1962 | Stanley . | |
| 3,101,984 | 8/1963 | Wieckmann . | |
| 3,660,800 | 5/1972 | Detch | 439/280 |
| 4,447,103 | 5/1984 | Werth et al. . | |
| 4,611,872 | 9/1986 | Ito et al. . | |
| 4,660,916 | 4/1987 | Williams, Jr. . | |
| 4,869,679 | 9/1989 | Szegda | 439/272 |
| 5,069,633 | 12/1991 | Straka et al. | 439/271 |
| 5,240,431 | 8/1993 | Yagi et al. | 439/271 |

*Primary Examiner*—Khiem Nguyen
*Assistant Examiner*—Eugene G. Byrd
*Attorney, Agent, or Firm*—Terry M. Gernstein

[57] ABSTRACT

A sealing ring is fixed to a light bulb to sealingly contact a top rim of a light bulb-receiving socket to seal the gap between the light bulb and the socket. The sealing ring is flexible and includes a base that is fixed to the light bulb, a bottom section that engages the top rim and a top portion that extends radially outward from the base farther than the radial extent of the bottom portion. The bottom portion includes an arcuate section that flexes as the bulb is screwed into the socket to ensure that the gap is fully sealed. The sealing ring and adhesive for fixing the sealing ring to the light bulb can be sold in a kit.

8 Claims, 4 Drawing Sheets

MEANS FOR SEALING A LIGHT BULB IN A SOCKET

TECHNICAL FIELD OF THE INVENTION

The invention relates to the general art of illumination, and to the particular field of light bulbs and accessories therefor.

BACKGROUND OF THE INVENTION

Light bulbs are so common today that many people do not even think about them. Today, literally millions and millions of light bulbs are sold. This enormous market includes light bulbs of all shapes, sizes and applications. One such bulb is used outside and is thus subject to moisture and dirt. Such bulbs are often left unattended for great lengths of time, especially in view of the many long life bulbs that are available in today's market.

Often, the moisture and/or contamination finds its way into the socket between the bulb threaded section and the socket threaded section. This contamination may cause the bulb to become jammed in the socket. A jammed bulb is especially onerous if the bulb is in a difficult-to-reach location. Some bulbs become so jammed as to require special tools to remove them from their sockets, or during removal break. If the bulb breaks during removal, there are special problems created. Sometimes the jamming is so tight as to require removal and replacement of the entire socket.

While the prior art contains examples of housings used to cover a bulb, this prior art does not suggest a means whereby a bulb of any sort can be easily and efficiently protected from the environment. That is, a means that is easily accessible to a purchaser of a light bulb without requiring modification of the socket and without being unduly expensive or unduly difficult to install, yet which is also effective.

Ideally, this means should be available through the light bulb channels of trade, and should not interfere with the operation of the bulb or with its removal from the socket.

Therefore, there is a need for a means and method for protecting a light bulb from becoming jammed into a socket due to environmental factors yet which is easy and inexpensive to install and which is readily available yet which does not interfere with the operation or removal of the light bulb itself.

OBJECTS OF THE INVENTION

It is a main object of the present invention to provide a means and a method for protecting a light bulb from becoming jammed into a socket due to environmental factors.

It is another object of the present invention to provide a means and method for protecting a light bulb from becoming jammed into a socket due to environmental factors which is easy to install and does not interfere with operation of the light bulb.

It is another object of the present invention to provide a means and method for protecting a light bulb from becoming jammed into a socket due to environmental factors which is easy to install and does not interfere with removal of the light bulb from the socket when desired.

It is another object of the present invention to provide a means and method for protecting a light bulb from becoming jammed into a socket due to environmental factors which is easy to install and which is readily available to a purchaser of a light bulb.

It is another object of the present invention to provide a means and method for protecting a light bulb from becoming jammed into a socket due to environmental factors which is easy to install and which is readily available to a purchaser of a light bulb and which is inexpensive.

SUMMARY OF THE INVENTION

These, and other, objects are achieved by a combination which includes a light bulb and a sealing ring that is fixed to the light bulb superadjacent to the threads on that base. This placement of the sealing ring locates it to abuttingly engage the top rim of a socket into which the threaded portion is received by cooperating engagement of the threads on the bulb base with threads in the socket as is understood by those skilled in the art.

The light bulb and the sealing ring can be sold as a kit which can also include a glue or other such adhesive and instructions for placing the adhesive on the bulb base and then placing the sealing ring, which is preferably elastomeric, on the adhesive. The preferred form of the kit includes a plurality of sealing rings. The seal is in a special form to ensure proper sealing of the light bulb in the socket.

Once the sealing ring is in place and engages the top rim of the socket, it will seal the area between the bulb and the socket to prevent moisture or dirt from entering the socket. This moisture and/or dirt is the most common cause of a light bulb becoming jammed in a socket.

BRIEF DESCRIPTION OF THE DRAWING FIGURES

DETAILED DESCRIPTION OF THE PREFERRED EMBODIMENT OF THE INVENTION

Figure 1:
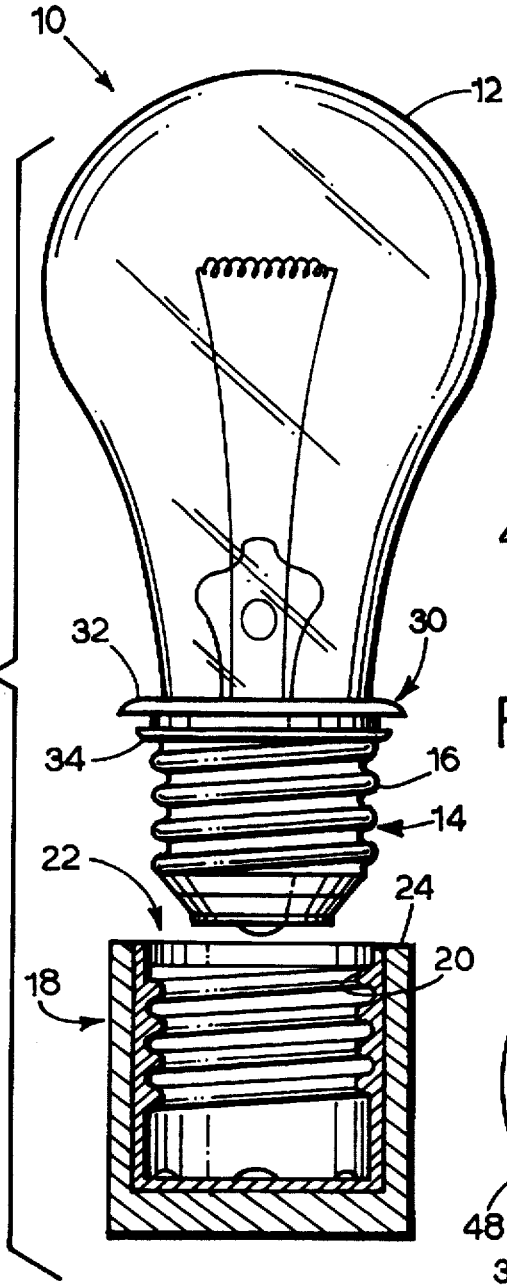
FIG. 1 shows a light bulb with a sealing ring in place thereon in accordance with the disclosure of this invention.

Shown in FIG. 1 is a light bulb 10 having a bulb portion 12 and a base 14. As is known in the art, base 12 includes an external thread 16 which is cooperatively received by a thread located inside a socket 18 having an internal thread 20 that cooperatively engages thread 16 so proper electrical contact is made between the light bulb and the socket to activate the light bulb in the known manner.

As was discussed above, moisture and/or dirt often lodges between the cooperating threads and makes it difficult to properly and efficiently remove the light bulb from the socket. This matter usually enters the socket via a gap 22 defined between the bulb base and the socket and moves past top rim 24 of the socket. Gap 22 is shown exaggerated in size in FIG. 1 for the sake of illustration; however, there is a gap present and any gap size will be sufficient to permit entry of moisture and small particles of dirt if the bulb and socket are exposed to the an environment containing such material long enough.

Therefore, the present invention has a sealing ring 30 fixed to the light bulb, preferably immediately superadjacent to the topmost portion of thread 16. Sealing ring 30 is flexible, preferably elastomeric, such as rubber or the like, and includes a top section 32 and a bottom section 34. Bottom section 34 abuttingly engages top rim 24 when the light bulb is screwed into socket 18 and closes gap 22 and seals the area between base 14 and socket 18 thereby preventing unwanted material from entering the socket between the bulb and the socket. As will be discussed below, sealing ring 30 compresses and deforms as the bulb is being screwed into the socket so proper sealing is ensured for a wide variety of sockets and bulbs and the desired degree of sealing can be selected by a user. The sealing ring can also double seal the gap if desired as will be understood from the following disclosure.

Figure 2A:
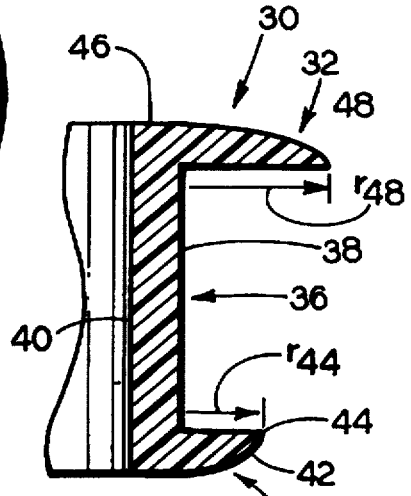
FIG. 2A is a side elevational view of a sealing ring according to the teaching of the present invention.
Figure 2B:
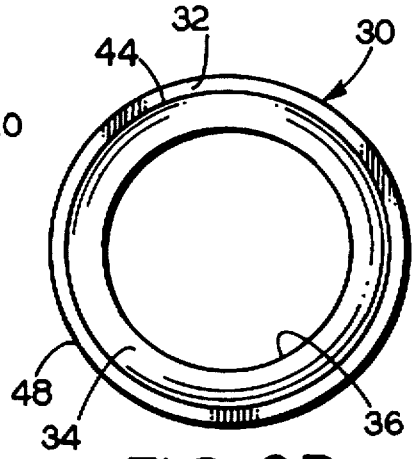
FIG. 2B is a bottom plan view of a sealing ring.
Figure 2:
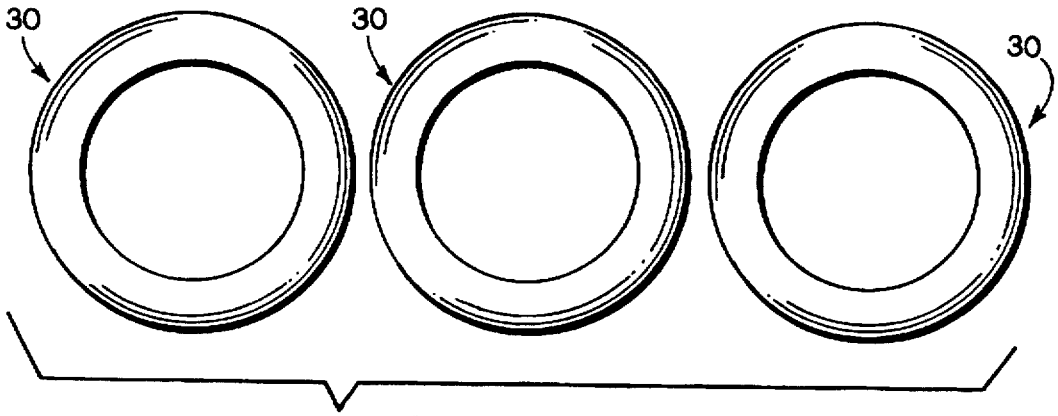
FIG. 2 is a top plan view of a plurality of sealing rings according to this invention.

Sealing ring 30 is shown in FIGS. 2, 2A and 2B. A plurality of sealing rings will be sold in a kit as will be discussed below, therefore three sealing rings are shown in FIG. 2. Sealing ring 30 includes a cylindrical base section 36 that has an outer surface 38 and an inner surface 40 which engages the light bulb and is fixed thereto. Bottom portion 34 extends radially outward from the base section and includes an arcuate bottom surface 42 that extends from the base section to a distal tip 44 that is spaced from outer surface 38 a distance $r_{44}$. Top section 32 extends radially outward from the base section and includes an arcuate top surface 46 that extends from the base portion to a distal tip 48 a distance $r_{48}$. As can be seen $r_{48}$ is greater than $r_{44}$. This locates tip 48 outside of the perimeter of the socket top rim 24 and deflects moisture and/or dirt away from gap 22. The arcuate shape of the sealing ring top surface 46 acts to smoothly effect this deflecting. The bottom surface 42 engages top rim 24 and the arcuate shape of the bottom surface permits that surface to deform into gap 22 and to adjust the amount of deformation to accommodate different sizes for gap 22 while still effecting a tight seal between sealing ring 30 and socket 18.

Figure 6:
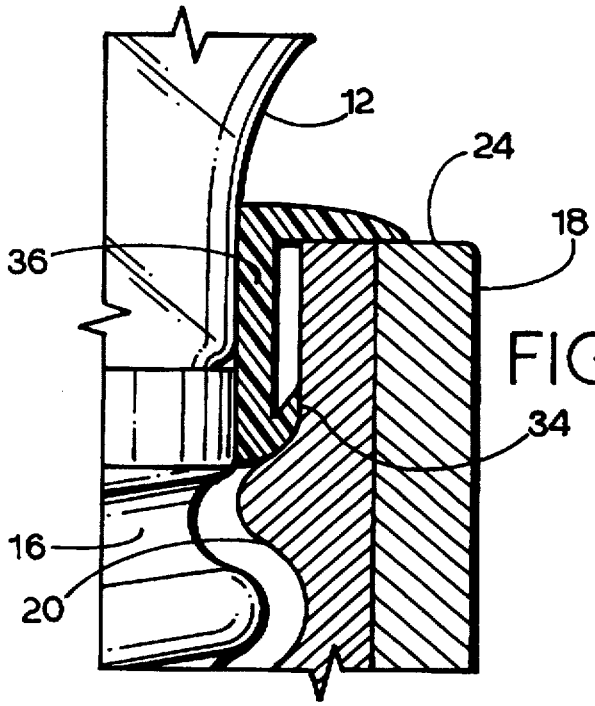
FIG. 6 illustrates a double seal that can be effected according to the present invention.

In some instances, such as will be discussed in connection with FIG. 6 below, bottom portion 34 can be jammed entirely inside the socket to further ensure that unwanted material does not pass into the socket. Top portion 32 is large enough to further seal off the gap in such a case.

Figure 3:
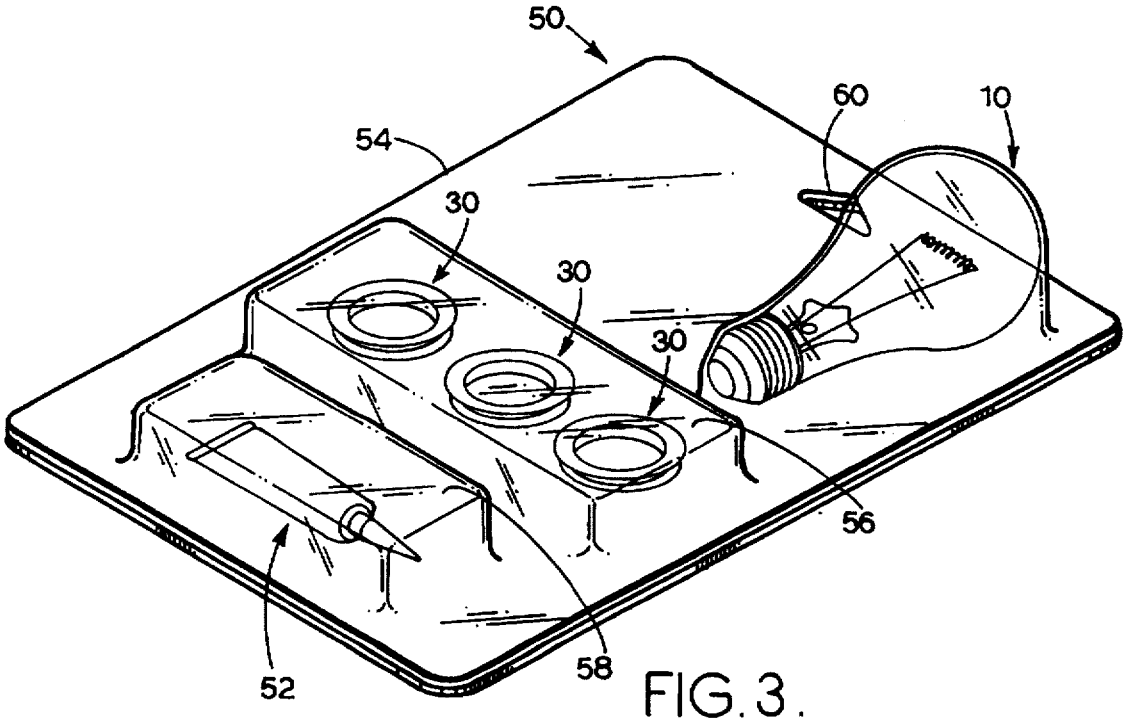
FIG. 3 shows a kit according to the disclosure of the present invention.

Shown in FIG. 3 is a kit 50 which includes a light bulb 10, a plurality of sealing rings 30, and means 52 for fixing the sealing ring to the light bulb. As shown in FIG. 3, kit 50 also includes a backing sheet 54 on which the above-mentioned items are mounted and covers, such as blister covers 56 and 58, for mounting these elements to the backing sheet whereby kit 50 can be sold in hardware stores or the like. A hole 60 is defined in backing sheet 54 so the kit can be hung from appropriate display hooks. While FIG. 3 shows glue as the means for fixing the sealing ring to the light bulb, other suitable fixing means can be used as will occur to those skilled in the art based on the teaching of this disclosure.

Figure 4A:
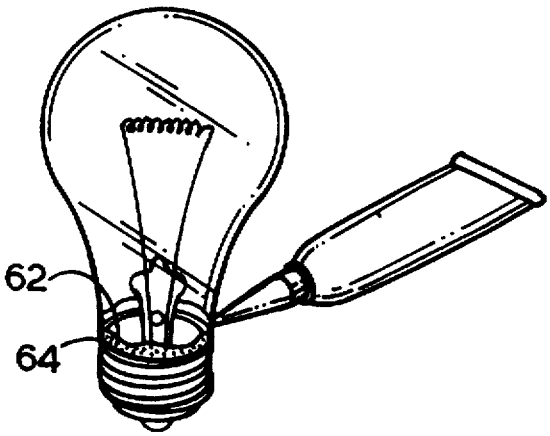
FIGS. 4A through 4C illustrate a method of fixing a sealing ring to a light bulb according to the present invention.
Figure 4B:
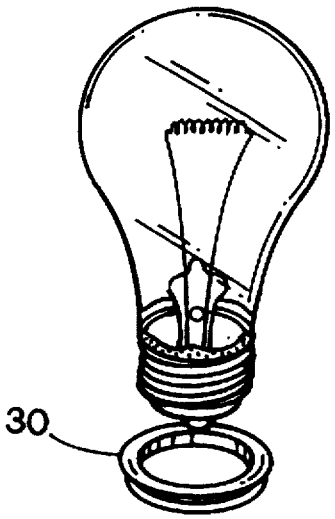
Figure 4C:
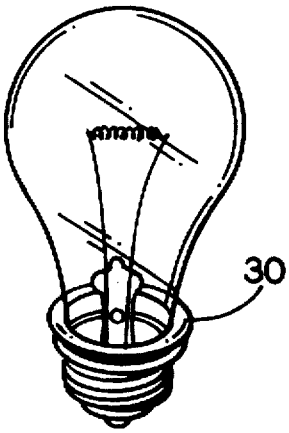

The method for placing the sealing ring on the light bulb is illustrated in FIGS. 4A–4C, and can be printed on backing sheet 54 to assist a user. As shown in FIG. 4A, adhesive 62 is placed on the light bulb, either on the glass portion or on the metal base portion, depending on the type of adhesive being used, immediately superadjecent to the topmost portion 62 of thread 16. The preferred form of the invention has adhesive on the glass portion of the light bulb as shown in FIG. 4A. Sealing ring 30 is then slipped over the threaded portion 16 until base 40 of the sealing ring contacts adhesive 62, as shown in FIG. 4C. When the sealing ring is in this position, the adhesive will adhere the sealing ring to the light bulb in the proper location. The light bulb is now ready to be inserted into a light socket.

Figure 5A:
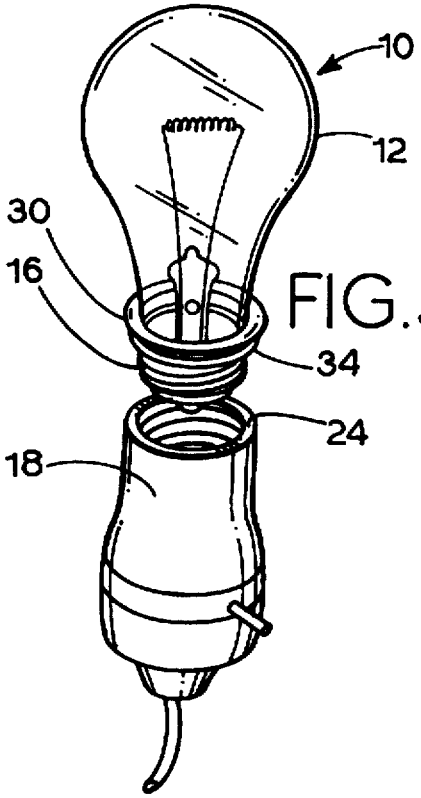
FIGS. 5A and 5B show placement of a light bulb with a sealing ring thereon into a socket according to the present invention.
Figure 5B:
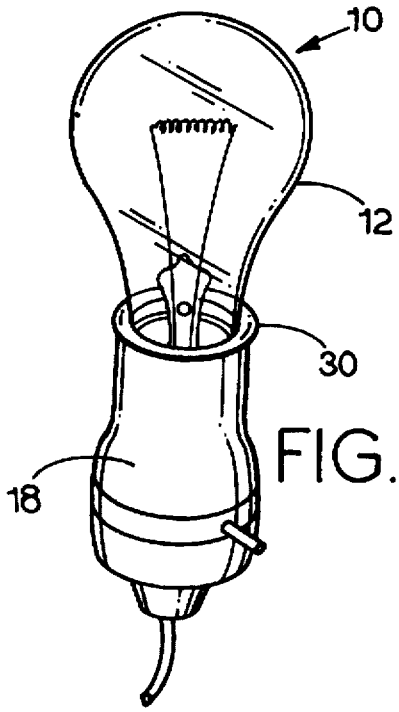

Insertion of the light bulb into the light socket is illustrated in FIGS. 5A and 5B. The light bulb threaded section is engaged with the socket threaded section as shown in FIG. 5A, and the light bulb is screwed into the light socket in the known manner until bottom section 42 of the sealing ring engages top rim 24 of the socket. Continued movement of the light bulb tightens the sealing ring against the socket to effect the desired degree of sealing. As above discussed, the arcuate nature of the sealing section 42 and the flexible nature of the sealing ring permits this adjustment of the sealing fit by permitting the sealing ring to flex as required. As was mentioned above, this flexing can even include doubling section 34 over until tip 44 contacts surface 38. After this, continued movement of the light bulb will force section 36 inside the socket. However, the larger nature of section 32 vis a vis section 34 has section 32 covering any gap that might still exist between the socket and the bulb. Section 34 thus is preferably has a radius $r_{48}$ that is larger than any expected gap 22 to be sure that effective sealing occurs no matter how large gap 22 is.

This relative sizes between sections 32 and 34 also can be used to effect a double seal if desired. Thus, light bulb 10 is screwed into socket 18 until section 34 is located entirely inside the socket and section 32 sealingly engages rim 24. This configuration is illustrated in FIG. 6.

It is understood that while certain forms of the present invention have been illustrated and described herein, it is not to be limited to the specific forms or arrangements of parts described and shown.

I claim:

1. A light bulb comprising:

A) a threaded base joined to a bulb portion and having threads thereon;

B) a sealing ring fixed to said base adjacent to said threads;

C) a light socket having an outer perimeter and threads defined on an inner surface of the light socket for cooperative engagement with the threads on said threaded base and being located adjacent to said base with a gap defined between a top portion of said base and a top portion of said socket adjacent to a top rim of said socket;

D) said sealing ring being located to sealingly engage said light socket when the light bulb is threadably received in the light socket;

E) said sealing ring including a cylindrical base portion, a top section and a bottom section, said top section and said bottom section each extending radially outward from said base portion with said top section extending outward a distance greater than said bottom section, said top section having an outer tip, each of said sections having an arcuate outer surface and an inner surface, a portion of the arcuate outer surface of said bottom section being located in said gap between the base of the bulb and the light socket with the outer tip of said top section being located outside the outer perimeter of said light socket when the light bulb is threadably received in the light socket with the sealing ring in place between the light bulb and the light socket.

2. The light bulb defined in claim 1 wherein said bottom section is located entirely inside the socket in said gap when the light bulb is threadably received in the light socket with the sealing ring in place between the light bulb and the light socket.

3. The light bulb defined in claim 1 wherein said sealing ring is located to sealingly engage a top rim of said light socket.

4. The light bulb defined in claim 1 wherein said sealing ring is formed of elastomeric material.

5. The light bulb defined in claim 4 wherein said elastomeric material is rubber.

6. The light bulb defined in claim 1 further including means for fixing said sealing ring to said light bulb.

7. The light bulb defined in claim 6 wherein said means for fixing said sealing ring includes adhesive.

8. The light bulb defined in claim 1 wherein said sealing ring is located immediately superadjacent to said threads.

* * * * *